US011927423B2

(12) United States Patent
McPherson et al.

(10) Patent No.: US 11,927,423 B2
(45) **Date of Patent: *Mar. 12, 2024**

(54) HYBRID RISER FOR ARCHERY BOW

(71) Applicant: MCP IP, LLC, Sparta, WI (US)

(72) Inventors: Mathew A. McPherson, Norwalk, WI (US); Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/883,463

(22) Filed: Aug. 8, 2022

(65) Prior Publication Data

US 2022/0373289 A1 Nov. 24, 2022

Related U.S. Application Data

(63) Continuation of application No. 16/950,706, filed on Nov. 17, 2020, now Pat. No. 11,408,704, which is a continuation of application No. 16/352,719, filed on Mar. 13, 2019, now Pat. No. 10,837,732.

(60) Provisional application No. 62/642,468, filed on Mar. 13, 2018.

(51) Int. Cl.
*F41B 5/00* (2006.01)
*F41B 5/10* (2006.01)

(52) U.S. Cl.
CPC ..... *F41B 5/105* (2013.01); *F41B 5/00* (2013.01); *F41B 5/10* (2013.01)

(58) Field of Classification Search
CPC ..... F41B 5/00; F41B 5/10
See application file for complete search history.

(56) References Cited

U.S. PATENT DOCUMENTS

| | | | | |
|---|---|---|---|---|
| 2,665,678 | A * | 1/1954 | Bear | F41B 5/0015 273/DIG. 7 |
| 5,269,284 | A | 12/1993 | Pujos et al. | |
| 7,258,113 | B2 | 8/2007 | Piplel et al. | |
| 8,079,353 | B2 | 12/2011 | Davis et al. | |
| 8,425,820 | B2 | 4/2013 | Pilpel | |
| 8,807,125 | B1 | 8/2014 | Mathur et al. | |
| 9,032,946 | B1 | 5/2015 | Mathur et al. | |
| 10,837,732 | B2 | 11/2020 | McPherson et al. | |
| 11,408,704 | B2 | 8/2022 | McPherson et al. | |
| 2002/0079047 | A1 | 6/2002 | Andrews et al. | |
| 2005/0229912 | A1 | 10/2005 | Pilpel et al. | |
| 2015/0362281 | A1 | 12/2015 | Derus | |
| 2016/0025443 | A1 | 1/2016 | Valsecchi | |

* cited by examiner

*Primary Examiner* — John A Ricci
(74) *Attorney, Agent, or Firm* — Laabs Intellectual Property

(57) ABSTRACT

In some embodiments, an archery bow riser comprises a body defining a first end, a second end and a grip portion. The body defines a shooting axis and comprises a first portion and a second portion. The first portion comprises a metal and the second portion comprises carbon fibers. The first portion extends to a first side of the shooting axis and to a second side of the shooting axis, and the second portion extends to the first side of the shooting axis and to the second side of the shooting axis.

15 Claims, 23 Drawing Sheets

HYBRID RISER FOR ARCHERY BOW

CROSS-REFERENCE TO RELATED APPLICATIONS

This application claims the benefit and is a continuation of U.S. patent application Ser. No. 16/950,706, filed Nov. 17, 2020, which claims the benefit of U.S. patent application Ser. No. 16/352,719, filed Mar. 13, 2019, which claims the benefit of U.S. Patent Application No. 62/642,468, filed Mar. 13, 2018, the entire contents of each of which are hereby incorporated herein by reference.

BACKGROUND OF THE INVENTION

This invention relates generally to archery bows and more specifically to riser and frame constructions for archery bows. Archery bows generally include a riser, which forms the main structure of the bow. Known risers are often made from a metal such as aluminum, or alternatively from a composite material such as a polymer reinforced with glass or carbon fibers. Metal risers have certain benefits and drawbacks. Metal risers can be cut to any shape but can tend to be more flexible than composite risers. Screw threads can be formed directly in a metal, and fasteners used in the bow can engage the metal directly. Composite risers have different benefits and different drawbacks. Composite risers are typically formed in a mold, which can generally produce risers having only one shape; however, composite risers can have superior strength and deflection characteristics.

There remains a need for novel bow and riser designs that improve the bow by providing increased stiffness and/or lighter weight than prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow riser comprises a body defining a first end, a second end and a grip portion. The body defines a shooting axis and comprises a first portion and a second portion. The first portion comprises a metal and the second portion comprises carbon fibers. The first portion extends to a first side of the shooting axis and to a second side of the shooting axis, and the second portion extends to the first side of the shooting axis and to the second side of the shooting axis. In some embodiments, second portion extends continuously for at least one-quarter of a length of the riser. In some embodiments, second portion extends continuously for at least one-half of a length of the riser.

In some embodiments, the body comprises a first limb engagement location and a second limb engagement location. The first portion extends continuously from the first limb engagement location to the second limb engagement location. The second portion extends continuously from the first limb engagement location to the second limb engagement location.

In some embodiments, an archery bow comprises a riser engaged with a first limb fastener and a second limb fastener. The riser comprises a first portion comprising metal and a second portion comprising carbon fiber. The riser comprises a tension surface and a compression surface. The second portion receives tensile forces from the first limb fastener and from the second limb fastener. The compression surface excludes the second portion.

In some embodiments, the second portion comprises a first aperture arranged to receive the first limb fastener and a second aperture arranged to receive the second limb fastener. In some embodiments, the first portion comprises a limb nut aperture aligned with the first aperture.

In some embodiments, an archery bow comprises a riser, a first limb supported by the riser at a first support location and a second limb supported by the riser at a second support location. The riser comprises a first portion comprising a first material and a second portion comprising a second material, the second material having a higher elastic modulus than the first material. The first portion extends from the first support location to the second support location. The first portion is arranged to receive compressive forces from the first and second limbs. The second portion extends from the first support location to the second support location. The second portion is arranged to receive tensile forces from the first and second limbs.

In some embodiments, the first limb is attached to the riser by a limb bolt and a limb nut, and the first portion comprises a first limb nut aperture. In some embodiments, the second portion comprises a second limb nut aperture aligned with the first limb nut aperture. In some embodiments, the second portion comprises a limb bolt aperture. In some embodiments, the first portion comprises a third limb nut aperture aligned with the first limb nut aperture. In some embodiments, the first portion comprises a slot and the second portion is oriented in the slot.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
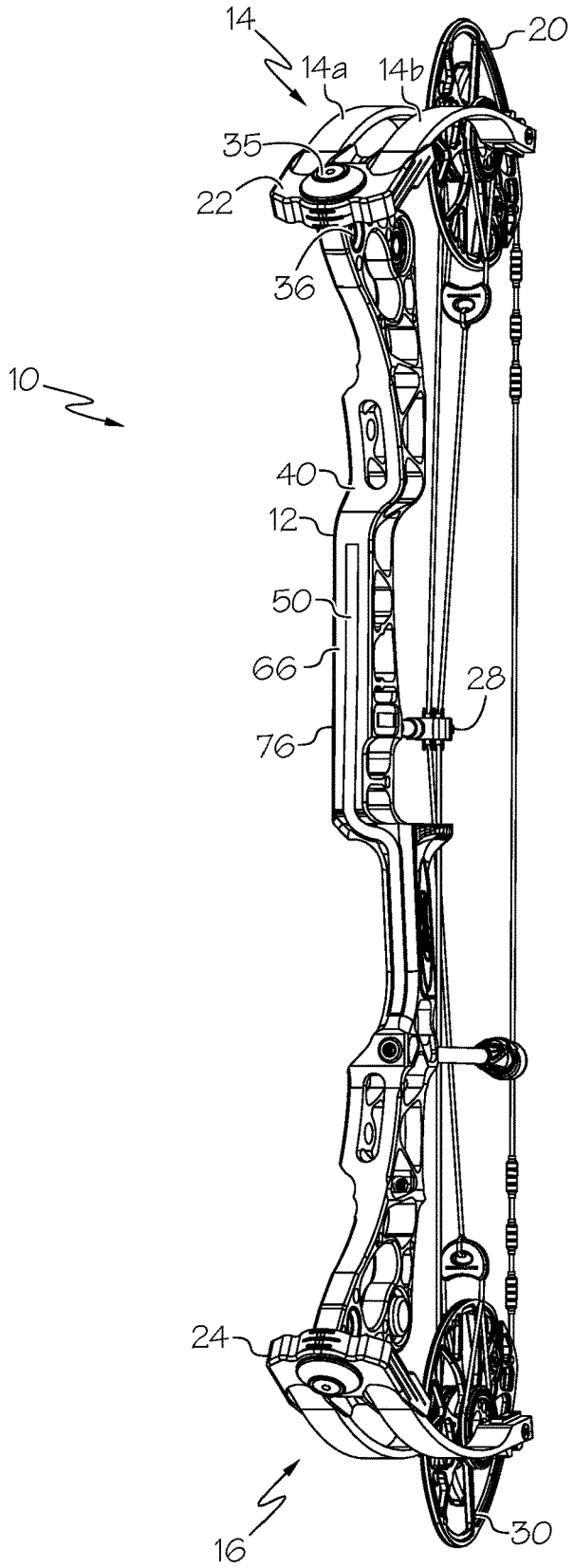
FIGS. 1-3 show different views of an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
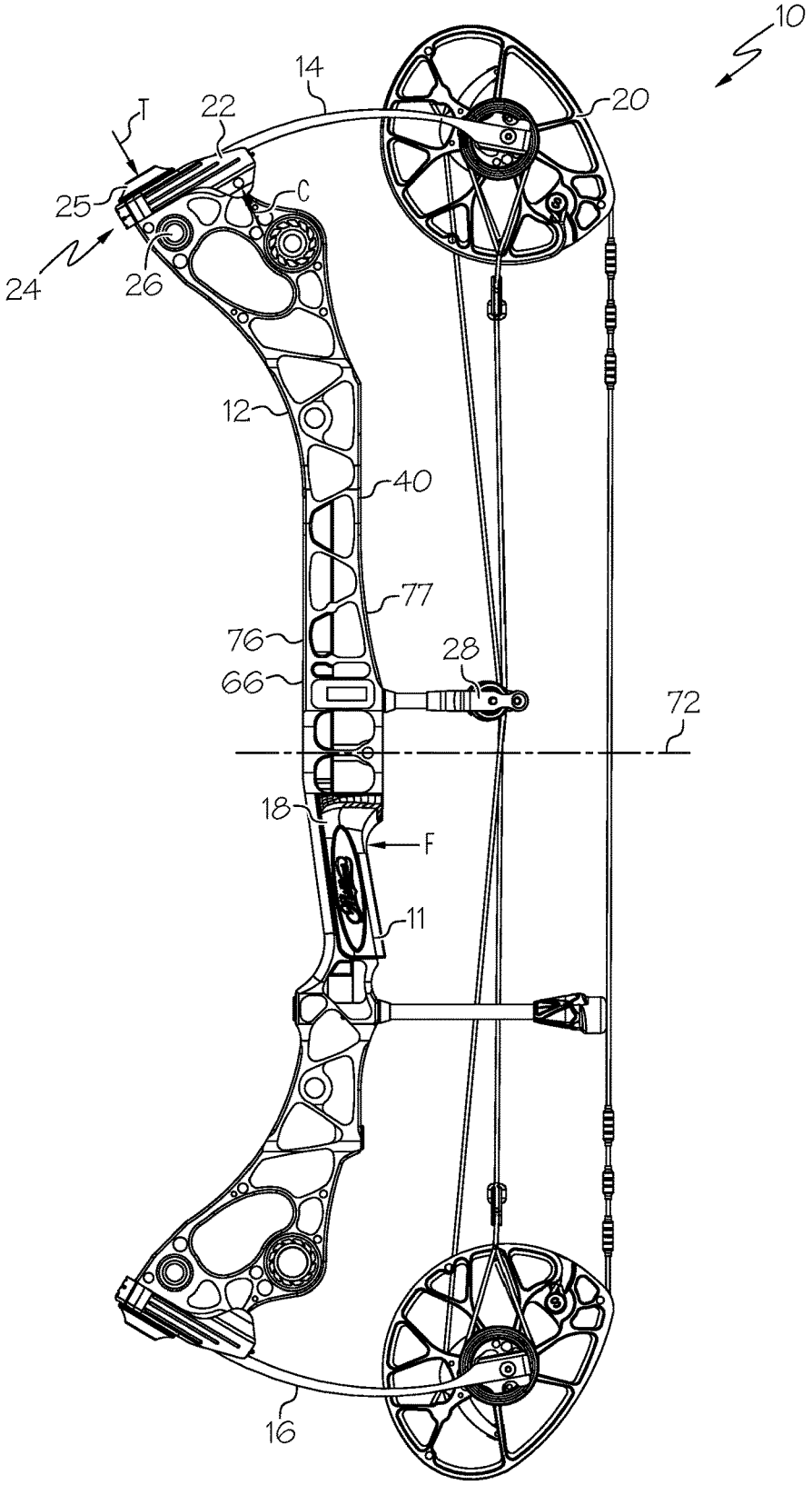
Figure 3:
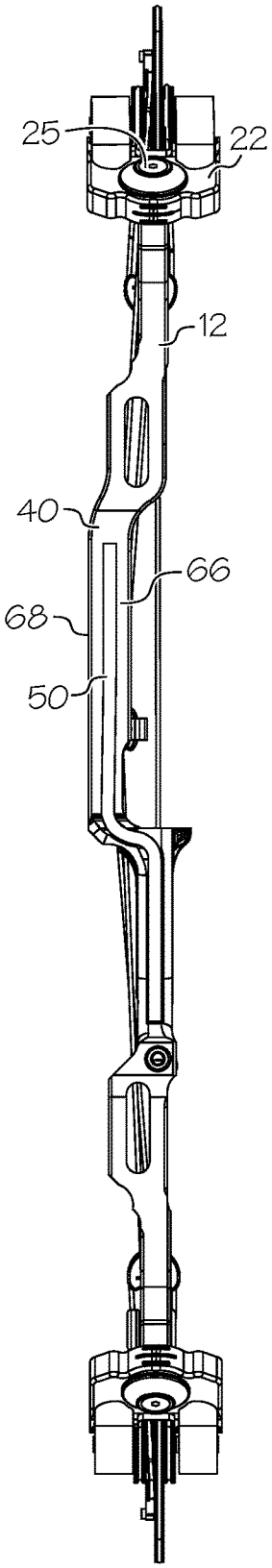

FIGS. 1-3 show an embodiment of an archery bow 10. In some embodiments, a bow 10 comprises a riser 12, a first limb 14 and a second limb 16. The first limb 14 supports a first rotatable member 20 and the second limb 16 supports a second rotatable member 30. In some embodiments, a limb (e.g. first limb 14) comprises a limb assembly having multiple limb members (e.g. 14*a*, 14*b*) as shown in FIG. 1.

In some embodiments, the limbs 14, 16 are attached to the riser 12 by limb cups 22, 24. In some embodiments, limbs 14, 16 and limb cups 22, 24 comprise features as disclosed in U.S. Pat. No. 8,453,635.

In some embodiments, the forces transferred between a limb 14 and the riser 12 comprise a moment connection, for example comprising a force couple comprising a compressive force C and a tensile force T. In some embodiments, a compressive force C is applied to the riser 12 by a limb cup 22. In some embodiments, a tensile force T is applied via a limb fastener 24 such as a limb bolt 35. In some embodiments, a head of a limb bolt 35 engages a limb cup 22. In some embodiments, a limb bolt 35 is attached to the riser 12, for example engaging a threaded hole in the riser 12. In some embodiments, the limb bolt 35 engages a limb nut 36 that comprises a threaded hole. In some embodiments, a limb nut 36 comprises a circular cross-sectional shape or a cylindrical outer shape, and is received in a cavity in the riser 12, which allows limb nut 36 to rotate and the angle of the limb bolt 35 with respect to the riser 12 to change, for example as the limb bolt 35 is adjusted.

Desirably, the bow 10 defines a shooting axis 72. In some embodiments, the bow 10 comprises a grip 11. In some embodiments, the grip 11 is attached to the riser 12 or comprises a portion of the riser 12. When shooting the bow 10, a shooter will typically grasp the grip 11 and apply a force F to the grip 11/riser 12. In some embodiments, the riser 12 acts as a beam and carries stresses, which may originate both from the bow's 10 internal forces and any from external force F applied by a shooter. Forces present in a riser 12 can primarily comprise tensile forces on the front side 76 of the riser 12 and compressive forces on the back side 77 of the riser 12. In some embodiments, a front surface of the riser 12 comprises a major tension surface 66 and a back surface 77 of the riser comprises a major compression surface.

In some embodiments, the bow 10 comprises a cable guard 28 arranged to move cables laterally, for example to position the cables away from the shooting axis 76. In some embodiments, the cable guard 28 is supported by the riser 12 and places a torqueing force on the riser 12. In some embodiments, forces from the cable guard 28 place one side of the riser 12 in tension and one side of the riser 12 in compression. In some embodiments, the riser 12 comprises a lateral tension surface 68.

In some embodiments, the riser 12 comprises a first portion 40 comprising a first material and a second portion 50 comprising a second material. In some embodiments, the second portion 50 comprises a material having a higher elastic modulus that the material of the first portion 40. In some embodiments, the second portion 50 has a greater stiffness than the first portion 40. In some embodiments, the first portion 40 consists of the first material and comprises a single piece of material. In some embodiments, the second portion 50 consists of the second material and comprises a single piece of material.

In some embodiments, the first portion 40 is formed from metal. Any suitable metal can be used. In some embodiments, the first portion 40 comprises aluminum.

In some embodiments, the second portion 50 comprises reinforcing fibers in a matrix material. The reinforcing fibers can comprise any suitable type of reinforcing material, such as carbon fiber, glass fiber, aramid fiber or the like and suitable combinations thereof. In some embodiments, the second portion 50 comprises carbon fiber in a resin matrix. In some embodiments, the reinforcing fibers of the second portion 50 consist of carbon fiber.

In some embodiments, the second portion 50 has a greater resistance to tensile deformation than the first portion 40, and the second portion 50 comprises a tensile stiffener that reinforces the riser 12 against deformation. In some embodiments, the second portion 50 is referred to herein as a stiffener 50.

Figure 4:
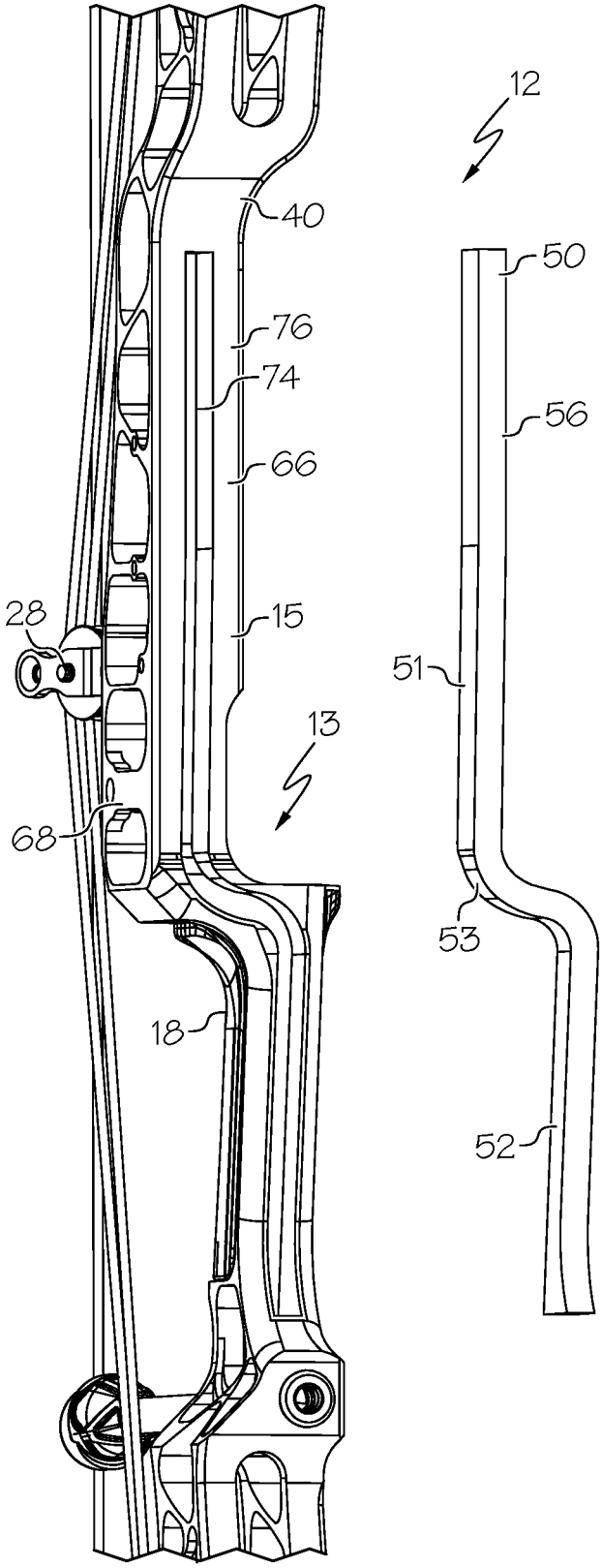
FIGS. 4 and 5 show an exploded view of an archery bow riser.
Figure 5:
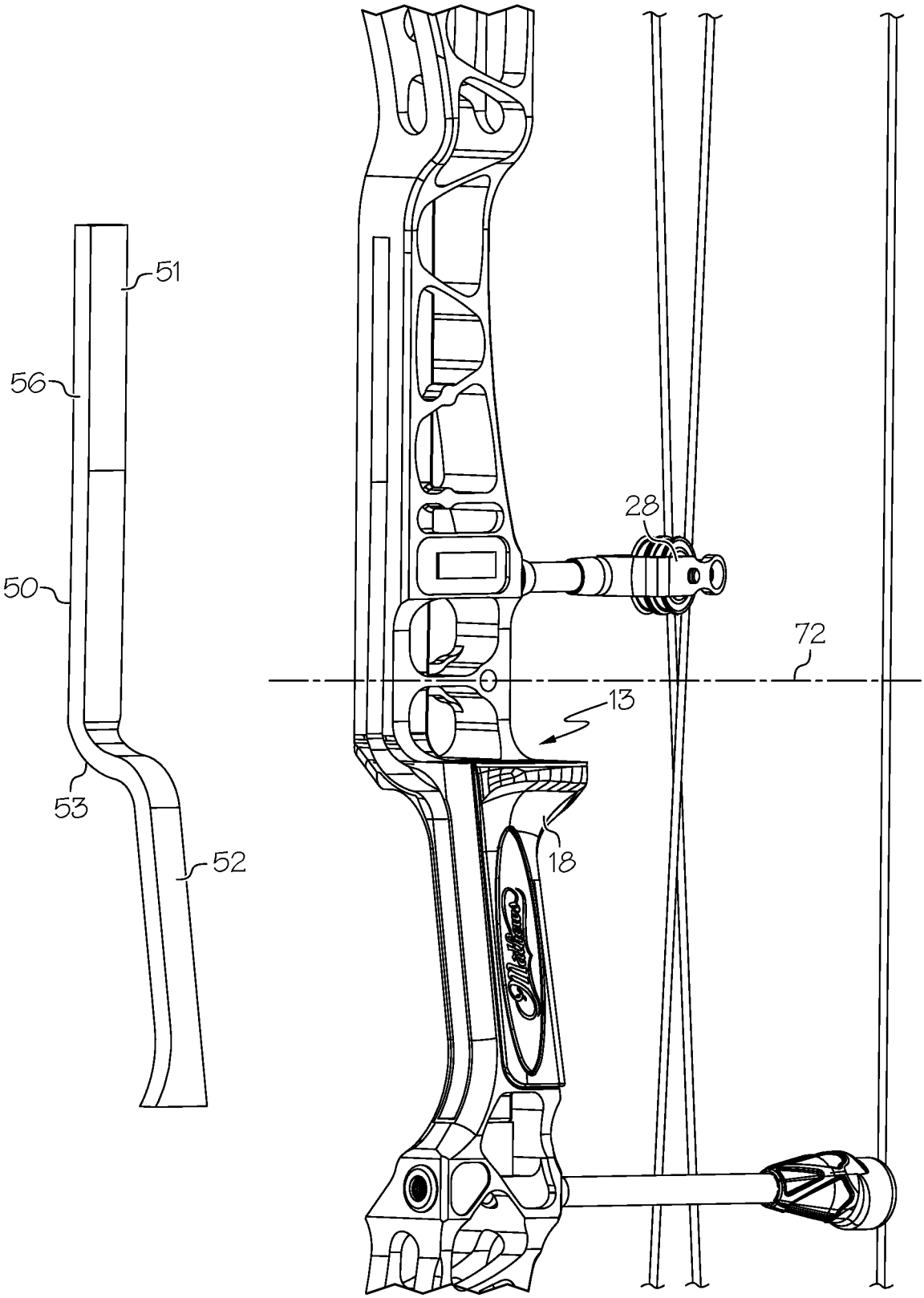
Figure 6:
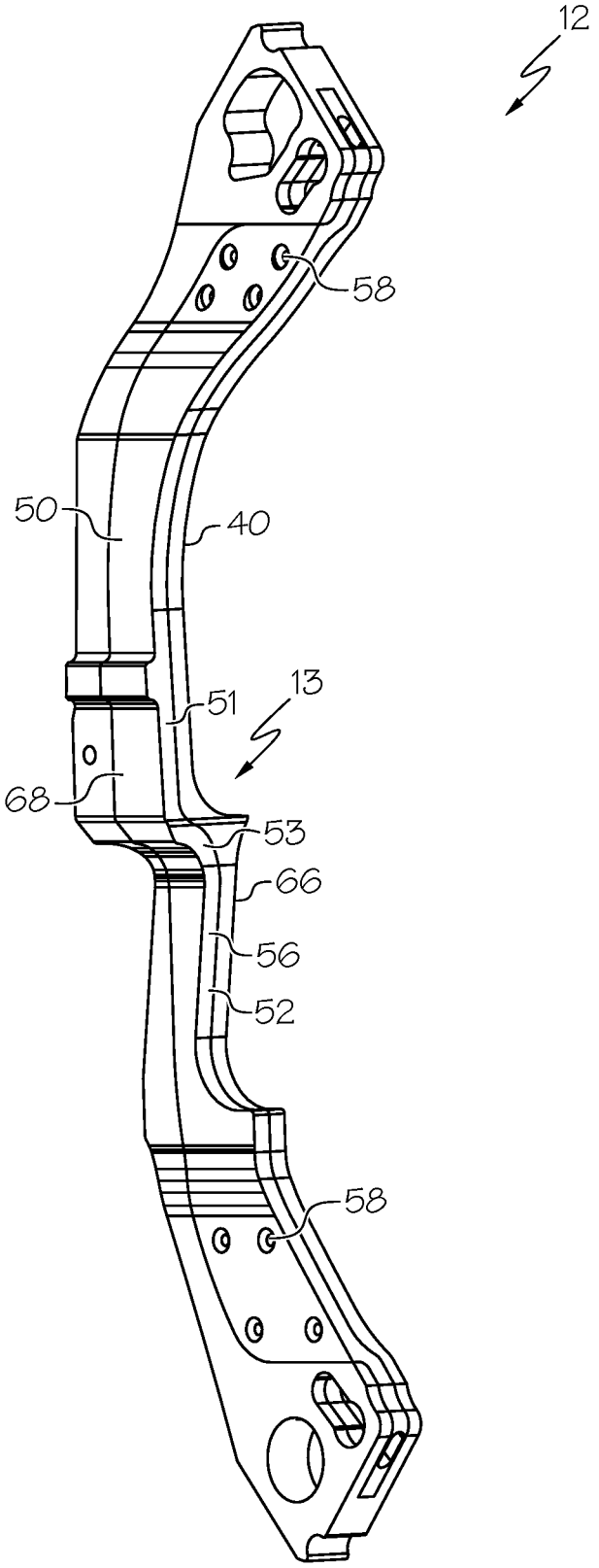
FIGS. 6-8 show views of another embodiment of an archery bow riser.
Figure 7:
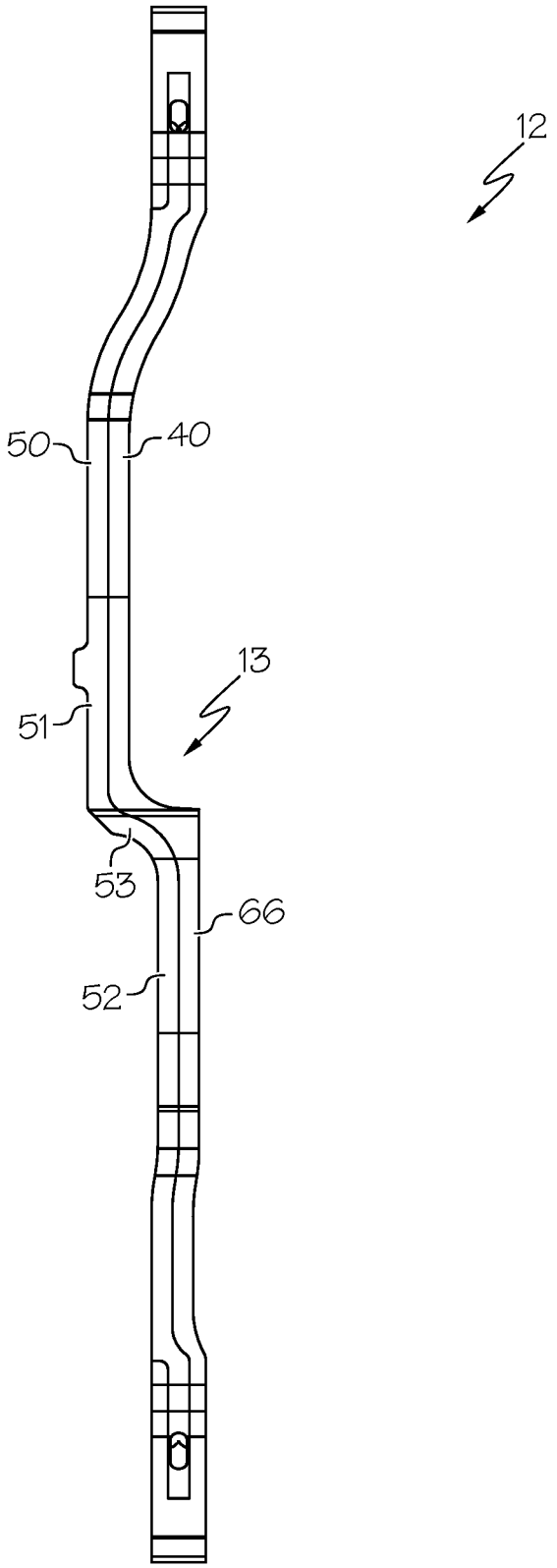
Figure 8:
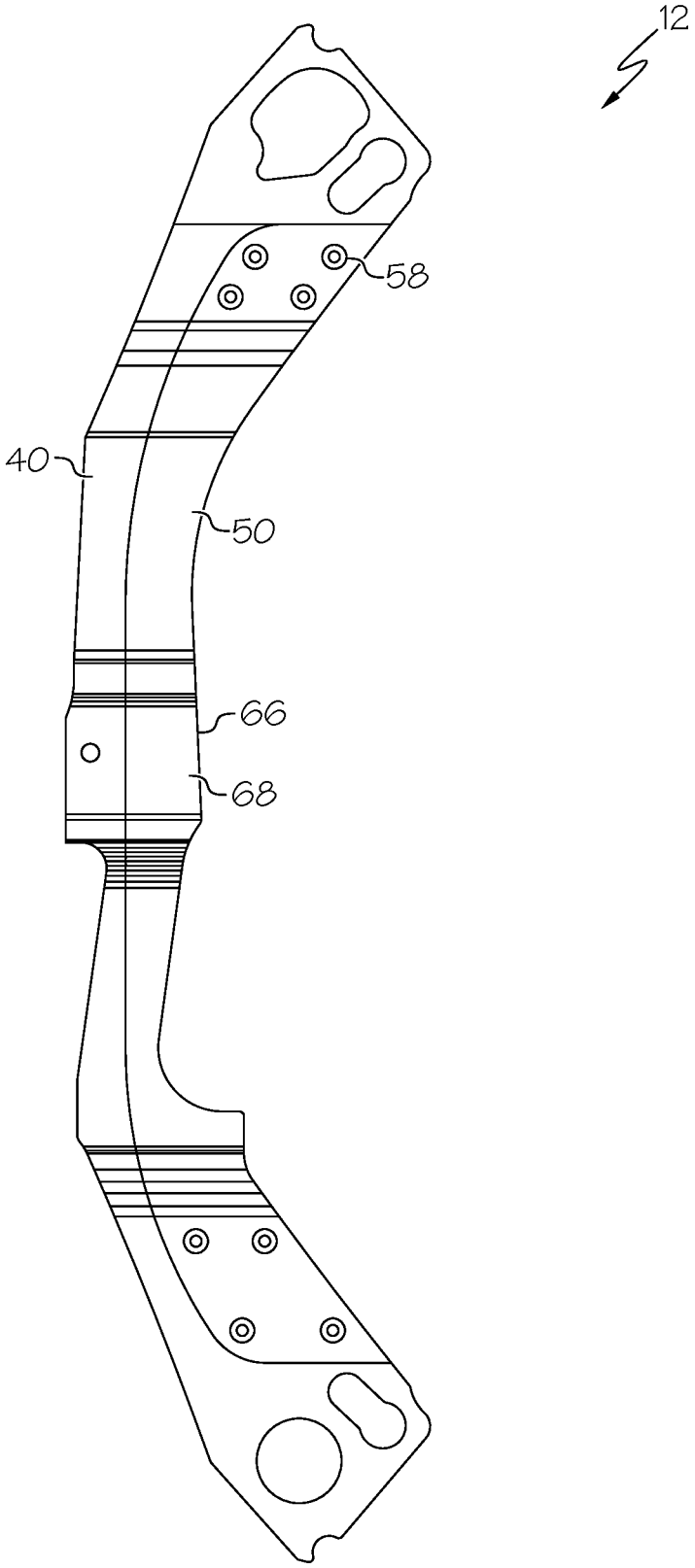
Figure 9:
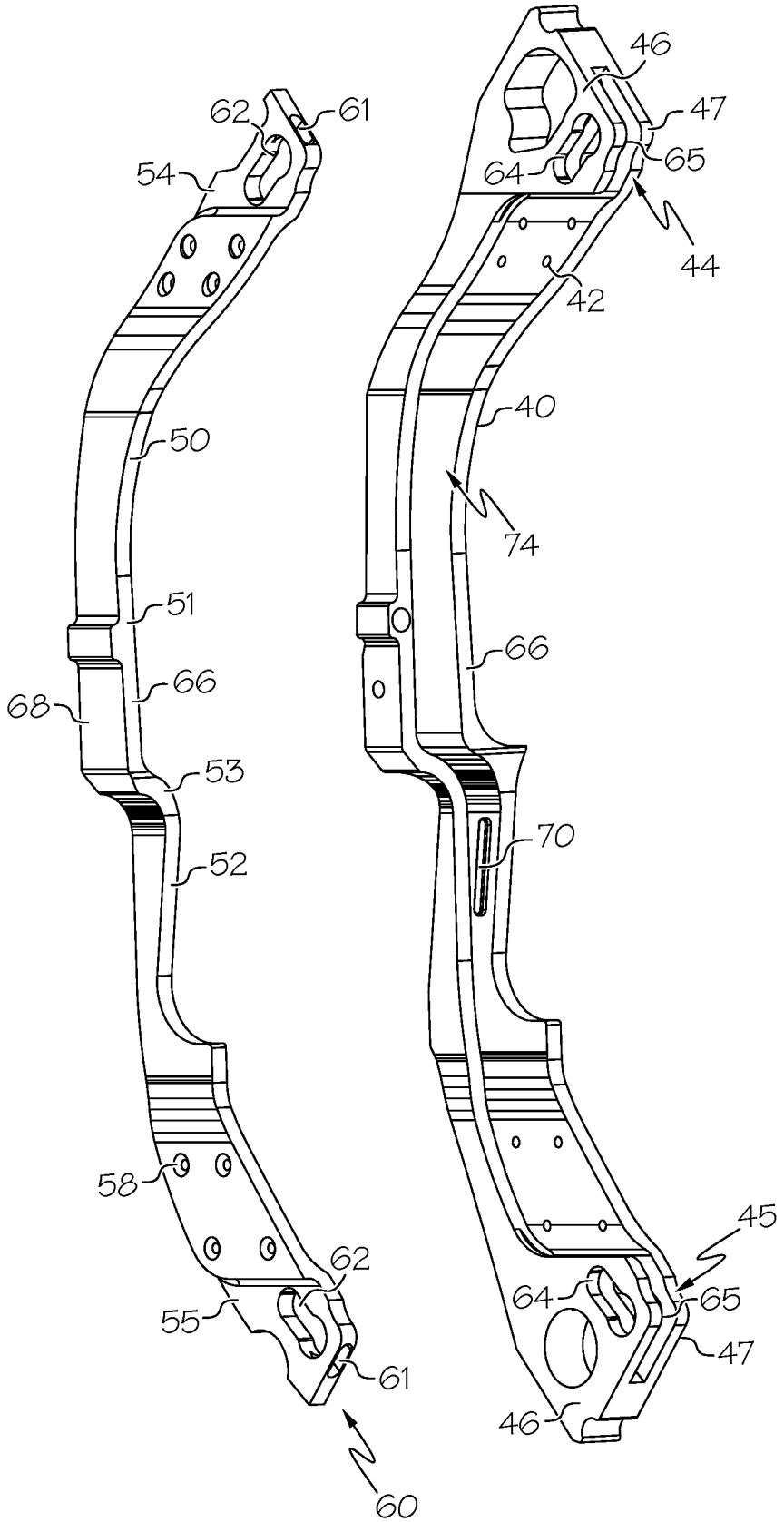
FIGS. 9-12 show exploded views of the riser shown in FIGS. 6-8.
Figure 10:
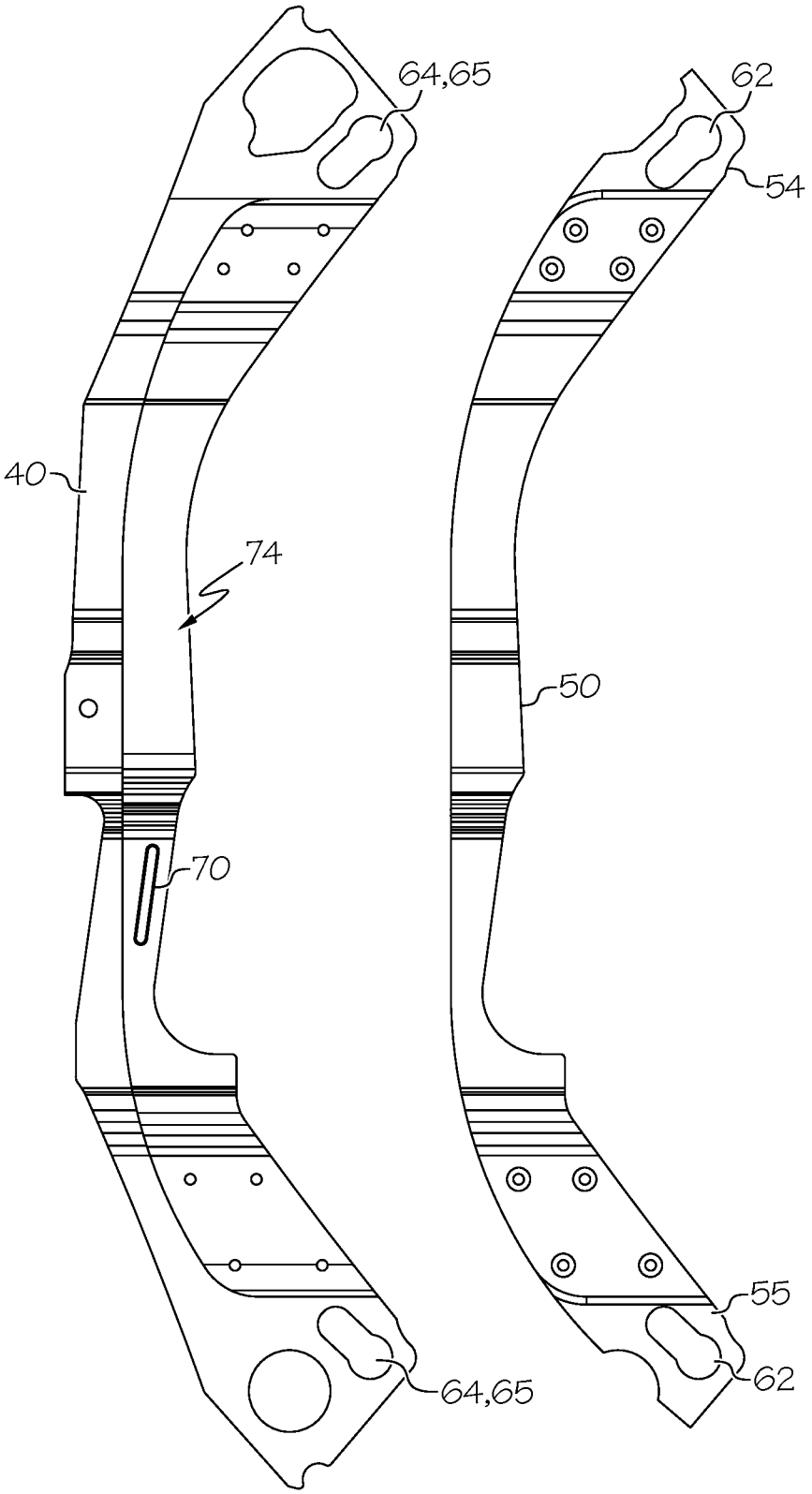
Figure 11:
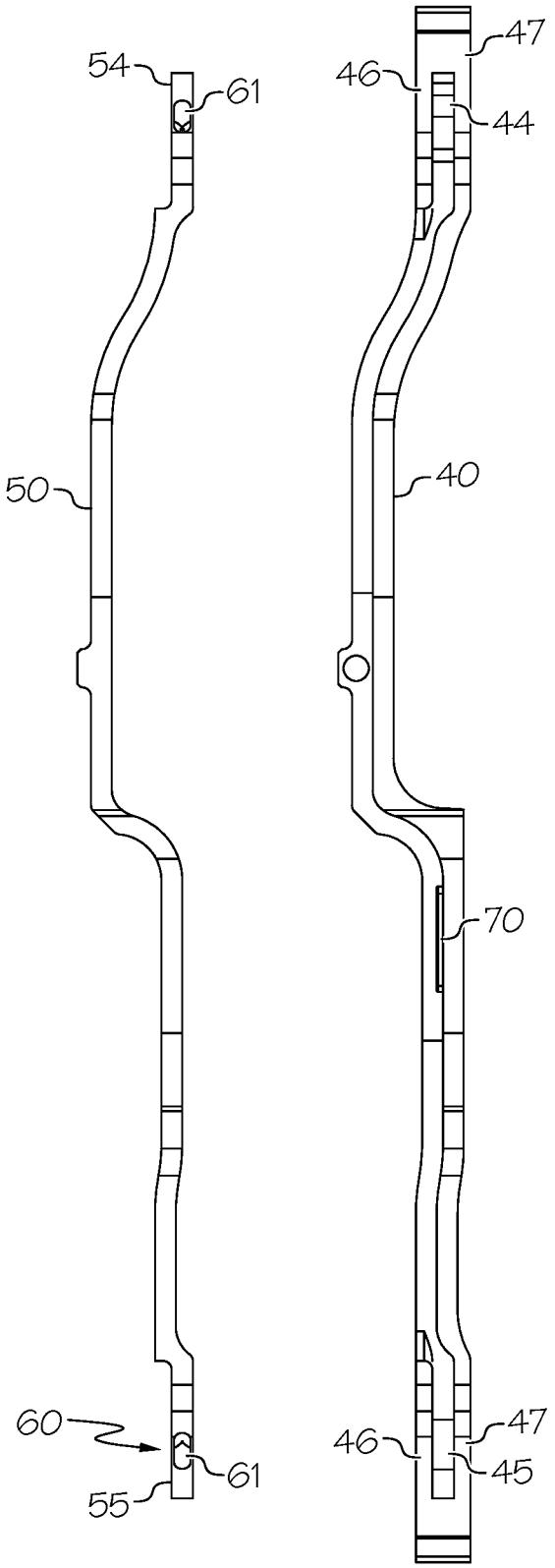
Figure 12:
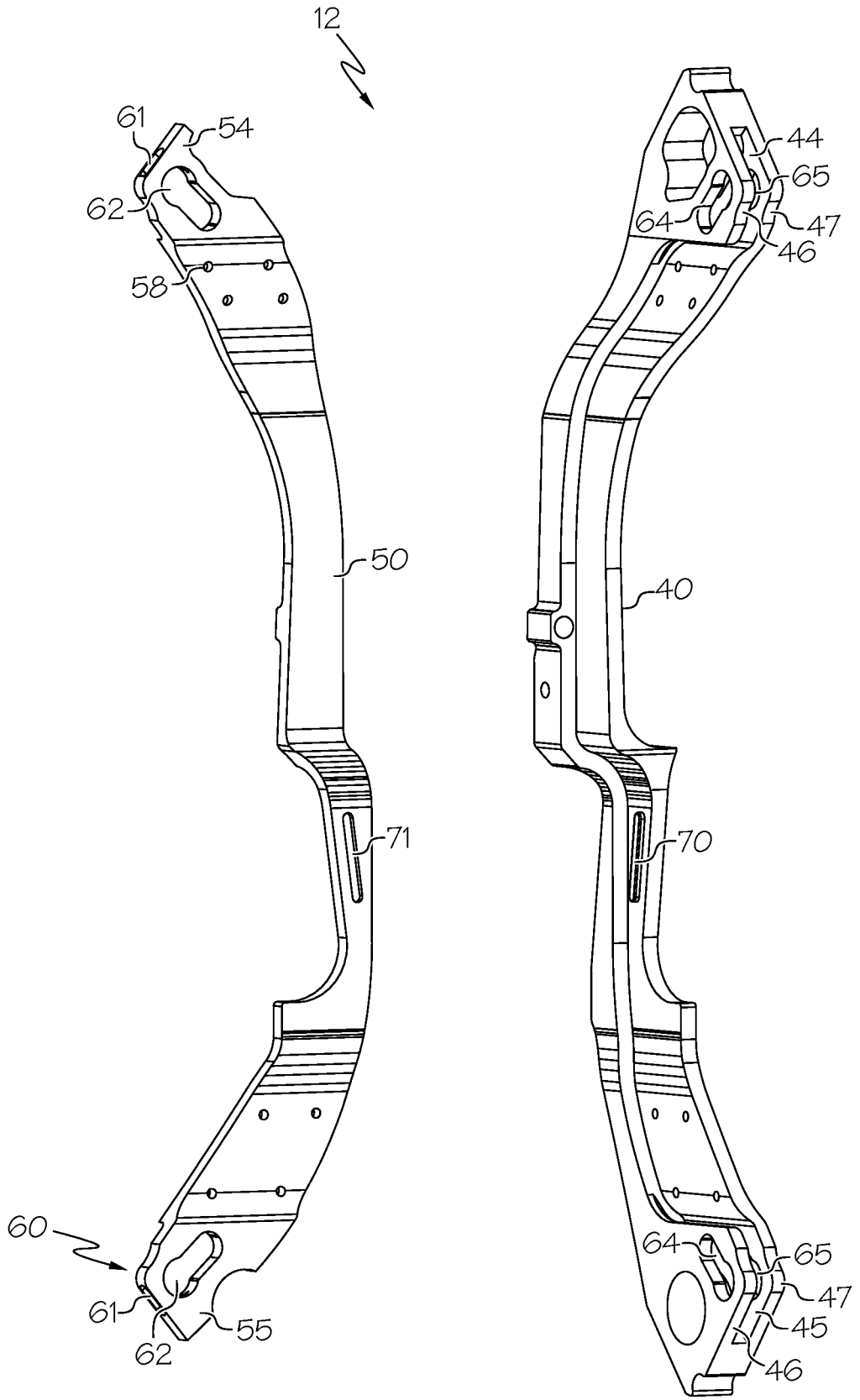

FIGS. 4 and 5 show views of the riser 12 shown in FIGS. 1-3 with the second portion 50 removed from the first portion 40.

In some embodiments, the first portion 40 of the riser 12 comprises a cavity 74. In some embodiments, the stiffener 50 is oriented in the cavity 74. In some embodiments, a size and shape of the cavity 74 is similar to the size and shape of the stiffener 50. In some embodiments, a stiffener 50 extends to the front surface 76 of the riser 12, or the front surface 76 of the first portion 40. In some embodiments, a front surface 56 of the stiffener 50 is aligned with the front surface 76 of the first portion 40. In some embodiments, the stiffener 50 extends to the major tension surface 66 of the riser 12. In some embodiments, the major tension surface 66 comprises the stiffener 50.

In some embodiments, the major tension surface 66 comprises both the first portion 40 and the second portion 50. In some embodiments, the major compression surface 77 comprises the first portion 40 and excludes the second portion 50.

The second portion 50 can be attached to the first portion 40 using any suitable method. In some embodiments, an adhesive is used. In some embodiments, multiple surfaces of the second portion 50 are attached to multiple surfaces of the first portion 40 with an adhesive. Any suitable adhesive can be used that will attach material of the second portion 50 to material of the first portion 40. In some embodiments, an adhesive comprises an epoxy, an epoxy mixture, an acrylic, a methacrylate and/or any other suitable adhesive.

In some embodiments, one or more fasteners can be used to attach the second portion 50 to the first portion 40. In some embodiments, the second portion 50 can comprise an aperture. In some embodiments, a fastener with a head extends through an aperture of the second portion 50 and engages the first portion 40. In some embodiments, a pin can engage (e.g. frictionally) the first portion 40 and the second portion 50. Any suitable combination of attachment methods can be used. In some embodiments, the first and second portions 40, 50 are attached to one another by at least one fastener and by an adhesive.

Any suitable number of surfaces of the second portion 50 can be attached to the first portion 40 by adhesive. In some embodiments, the second portion 50 comprises six sides, and any suitable number of sides can be attached by adhesive. As shown in FIGS. 4 and 5, all sides of the second portion 50 except the front surface 56 can be attached to the first portion 40.

The first portion 40 can be made using any suitable method. In some embodiments, the first portion 40 is cast in a mold. In some embodiments, the first portion 40 is cut from a workpiece.

The second portion 50 can be made using any suitable method. In some embodiments, the second portion 50 is formed in a mold. In some embodiments, the second portion 50 is formed in the cavity 74 using the cavity 74 as a mold. In some embodiments, an uncured slurry of matrix material and reinforcing fibers is deposited into the cavity 74 and then cured. In some embodiments, interior walls of the cavity 74 comprise a portion of a mold, and another exterior mold portion can be used to close the cavity 74 and allow injection molding under heat and/or pressure.

In some embodiments, a stiffener 50 comprises a first length portion 51 and a second length portion 52. In some embodiments, a longitudinal axis of the first length portion 51 is parallel to and offset from a longitudinal axis of the second portion 52. In some embodiments, the stiffener 50 comprises one or more curved portions 53. In some embodiments, the riser 12 comprises an offset portion 15 that defines a sight window 13. Desirably, the offset portion 15 is offset from the shooting axis 76. In some embodiments, the shooting axis 76 extends through the sight window 13. In some embodiments, the first portion 40 of the riser 12 extends above and below the shooting axis 76. In some embodiments, the stiffener 50 extends above and below the shooting axis 76. In some embodiments, the riser 12 first portion 40 and the stiffener 50 are attached to one another continuously and extend above and below the shooting axis 76.

In some embodiments, the stiffener 50 occupies at least a quarter of a length dimension (e.g. height dimension) of the riser 12. In some embodiments, the stiffener 50 occupies approximately one-third of the length dimension of the riser 12. In some embodiments, the stiffener 50 occupies approximately one-half of the length dimension of the riser 12. In some embodiments, the stiffener 50 does not extend to the limb connections.

In some embodiments, the riser 12 comprises a grip 18. In some embodiments, the grip 18 is positioned adjacent to a portion of the stiffener 50. In some embodiments, the grip 18 defines a cavity, and the riser 12 first portion 40 and the stiffener 50 are oriented in the cavity.

In some embodiments, the first portion 40 comprises portions positioned around the shooting axis 72. In some embodiments, the first portion 40 comprises portions located to a first side and to a second side (e.g. opposite sides) of the shooting axis 72. In some embodiments, the first portion 40 comprises portions located above and below the shooting axis 72.

In some embodiments, the second portion 50 comprises portions positioned around the shooting axis 72. In some embodiments, the first portion 40 comprises portions located to a first side and to a second side (e.g. opposite sides) of the shooting axis 72. In some embodiments, the first portion 40 comprises portions located above and below the shooting axis 72.

The second portion 50 can extend for any suitable length portion of the riser 12. In some embodiments, the second portion 50 extends continuously for one-quarter of a length of the riser 12. In some embodiments, the second portion 50 extends continuously for one-third of a length of the riser 12. In some embodiments, the second portion 50 extends continuously for one-half of a length of the riser 12.

FIGS. 6-12 show views of another embodiment of a riser 12. In some embodiments, the riser 12 comprises a first portion 40 and a second portion 50. In some embodiments, the second portion 50 occupies a majority of a length dimension of the riser 12. In some embodiments, the second portion 50 extends continuously between the limb 14, 16 connections. In some embodiments, the second portion 50 engages limb fasteners (e.g. 24).

In some embodiments, the second portion 50 comprises a portion of the major tension surface 66 of the riser 12. In some embodiments, the second portion comprises a portion of the lateral tension surface 68. In some embodiments, the second portion 50 comprises a single piece of material that comprises the major tension surface 66 and the lateral tension surface 68 of the riser 12. In some embodiments, the second portion 50 occupies a front-lateral tension quadrant of the riser 12 cross-section.

In some embodiments, all contacting surfaces between the first portion 40 and the second portion 50 of the riser 12 can be attached using an adhesive. In some embodiments, the first portion 40 and the second portion 50 are attached via pins, fasteners, etc. In some embodiments, a pin can extend through apertures in the first portion 40 and the second portion 50, for example frictionally engaging the apertures. As shown in FIGS. 6-12, the second portion 50 is arranged to receive fasteners. In some embodiments, a fastener can abut the second portion 50 and engage the first portion 40. In some embodiments, the first portion 40 comprises threaded apertures 42 arranged to engage a fastener. In some embodiments, the second portion 50 comprises apertures 58 arranged to receive a fastener. In some embodiments, apertures 58 in the second portion 50 are countersunk and provide a cavity for a head of a fastener.

In some embodiments, the cavity 74 defined by the first portion 40 comprises a first slot portion 44. In some embodiments, the cavity 74 comprises a second slot portion 45. In some embodiments, the first and second slot portions 44, 45 are located at or near opposite ends of the riser 12. In some embodiments, a slot portion 44, 45 is defined by a first sidewall 46 and a second sidewall 47.

In some embodiments, the second portion 50 comprises a first tab portion 54 and a second tab portion 55. In some embodiments, the first tab portion 54 of the second portion 50 is oriented in the first slot portion 44 of the first portion 40. In some embodiments, the second tab portion 55 of the second portion 50 is oriented in the second slot portion 45 of the first portion 40.

In some embodiments, surfaces of the first portion 40 and second portion 50 that contact one another are shaped to comprise complimentary mating surfaces. In some embodiments, such contacting surfaces of the first portion 40 and second portion 50 are attached with an adhesive. In some embodiments, the contacting surfaces of the first portion 40 and second portion 50 comprise mating protrusion and recess structures to aid in both alignment and force transfer between the portions 40, 50. As shown in the FIG. 12, in some embodiments, the first portion 40 comprises a protrusion 70 having a predetermined shape, and the second portion 50 comprises a mating recess 71.

Figure 13:
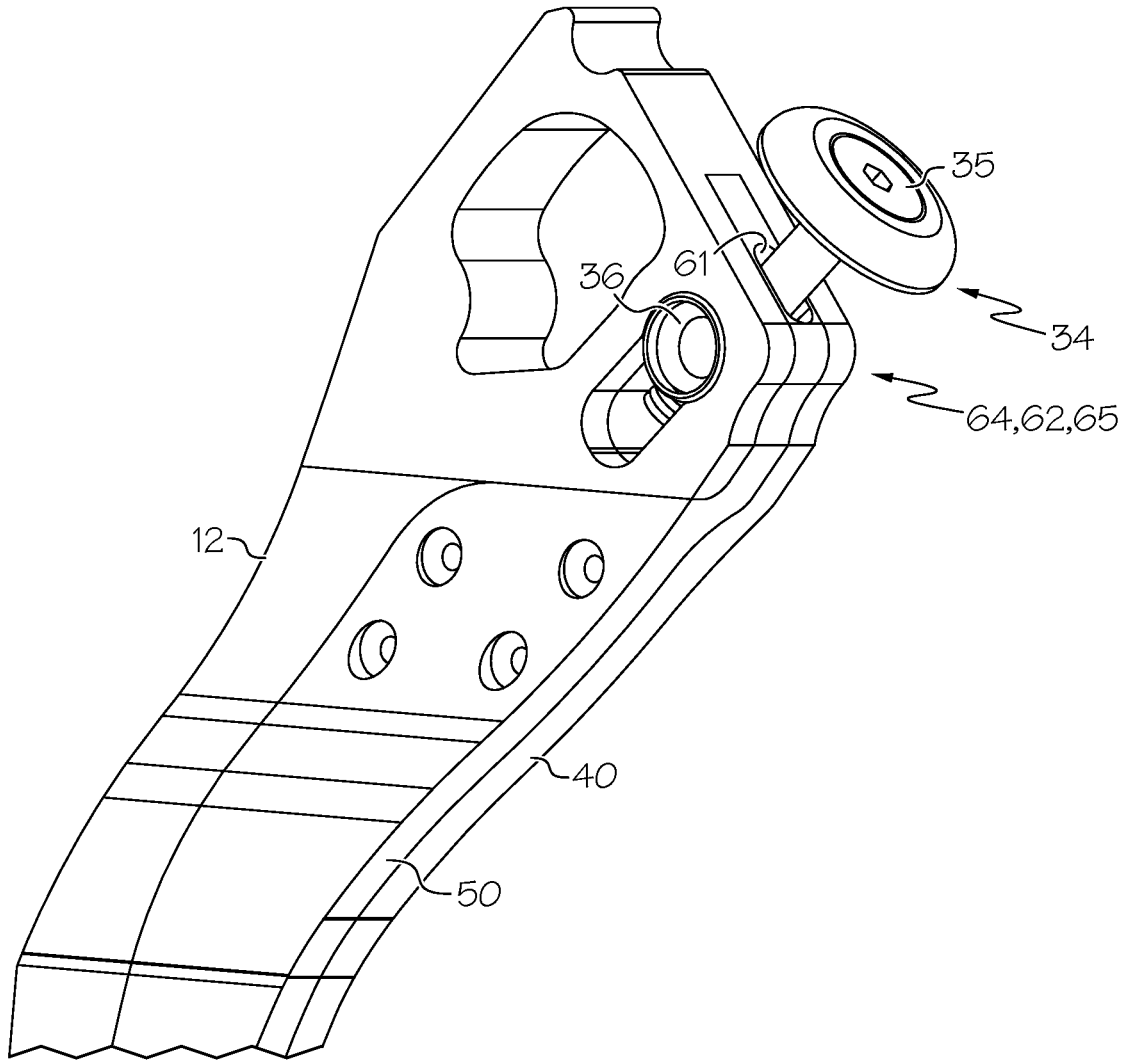
FIGS. 13-15 show the riser of FIGS. 6-8 engaged with limb fasteners.
Figure 14:
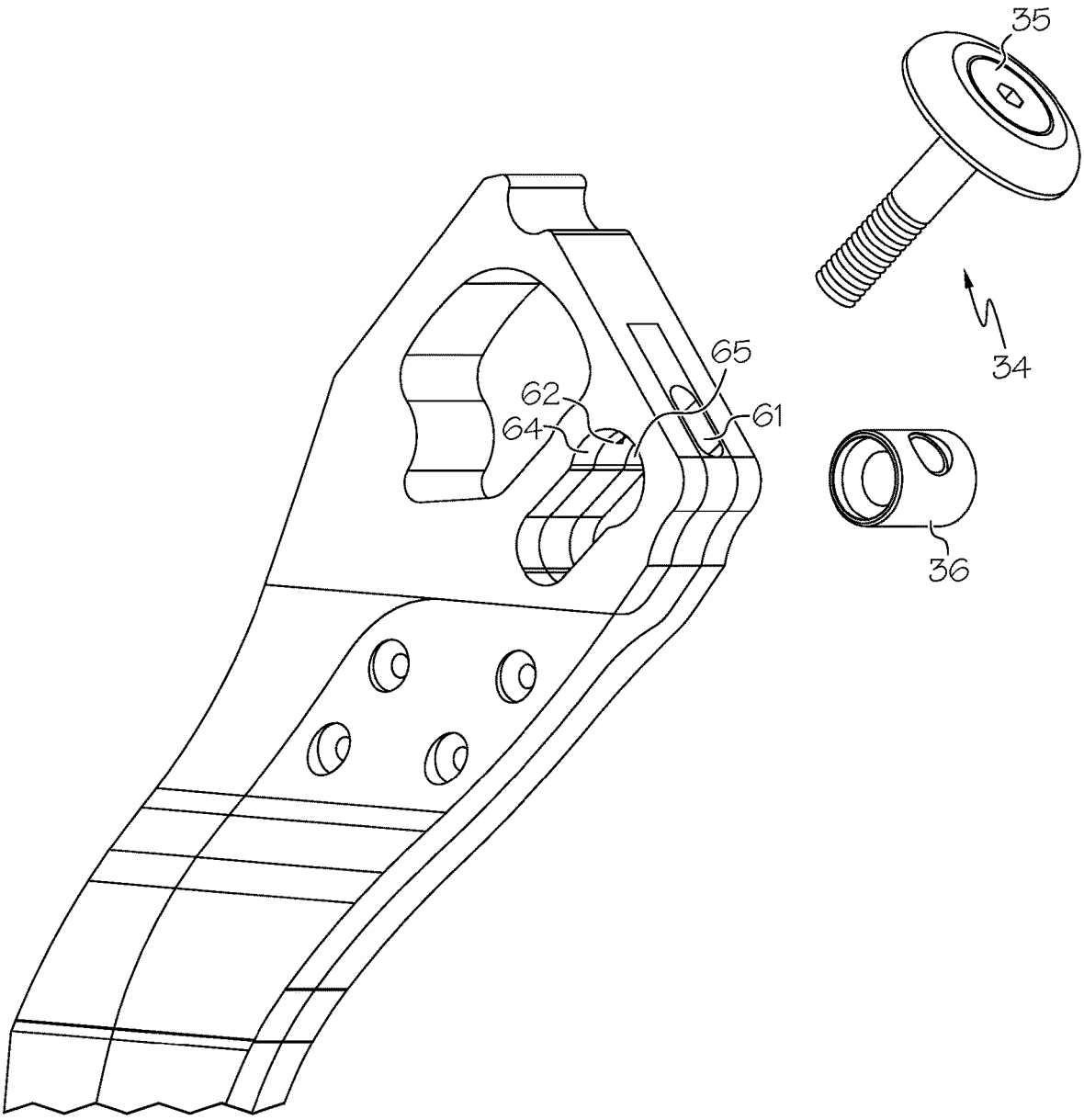
Figure 15:
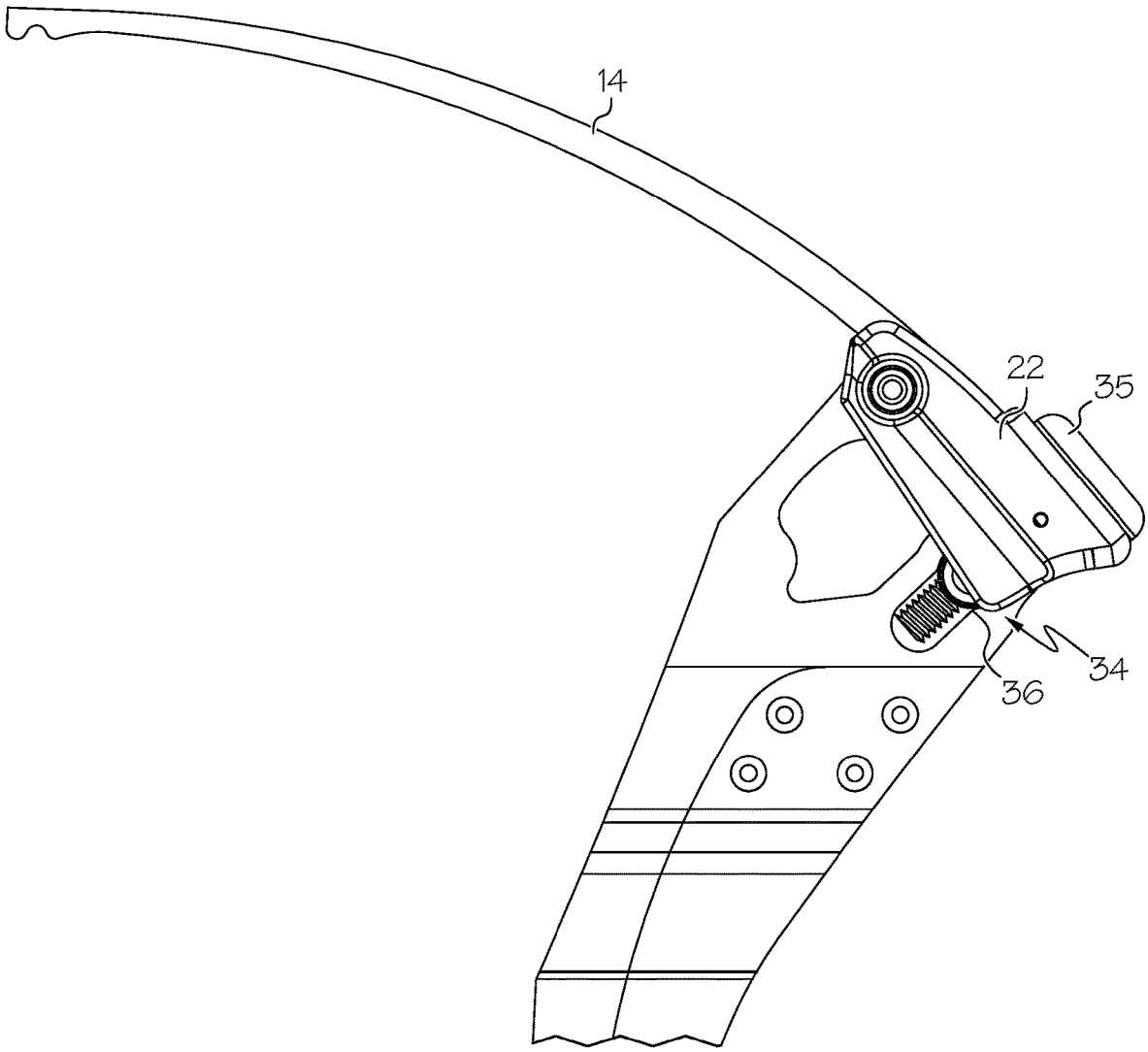
Figure 16:
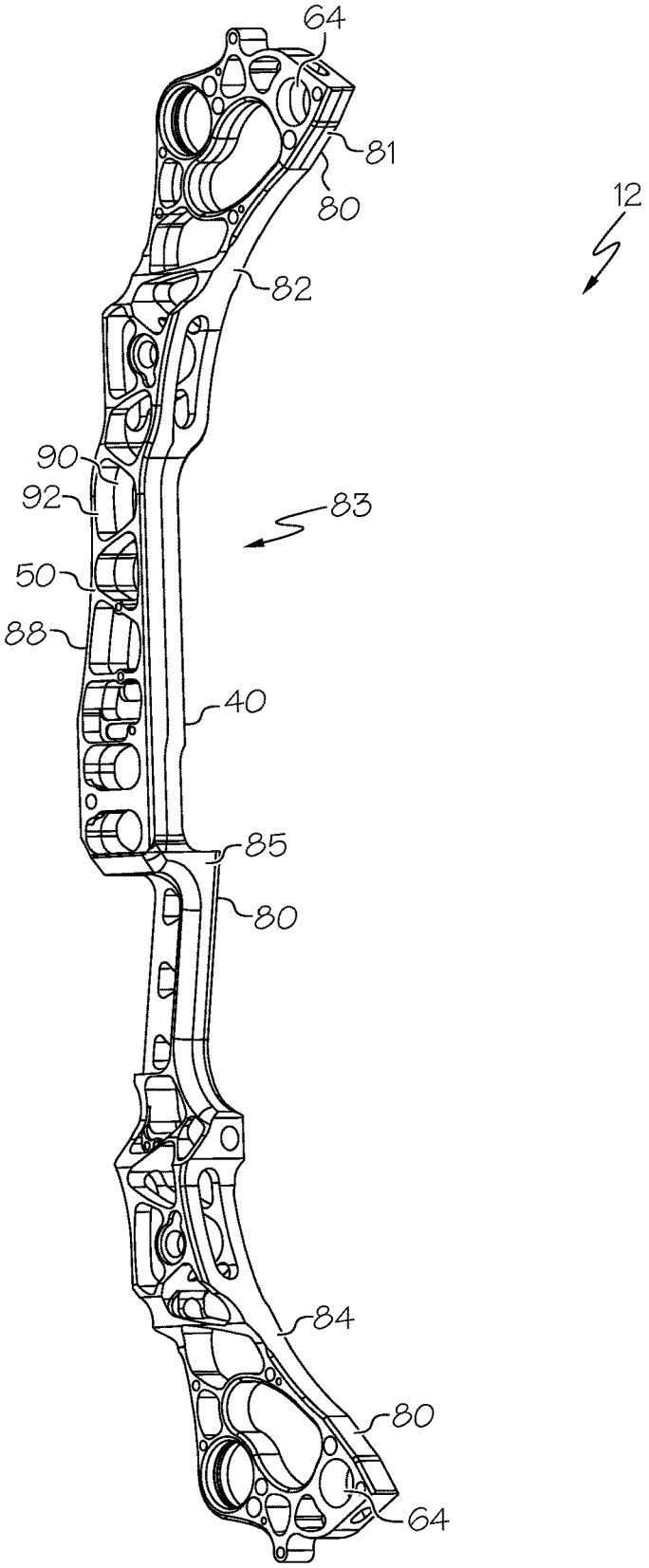
FIGS. 16-19 show another embodiment of a riser.
Figure 17:
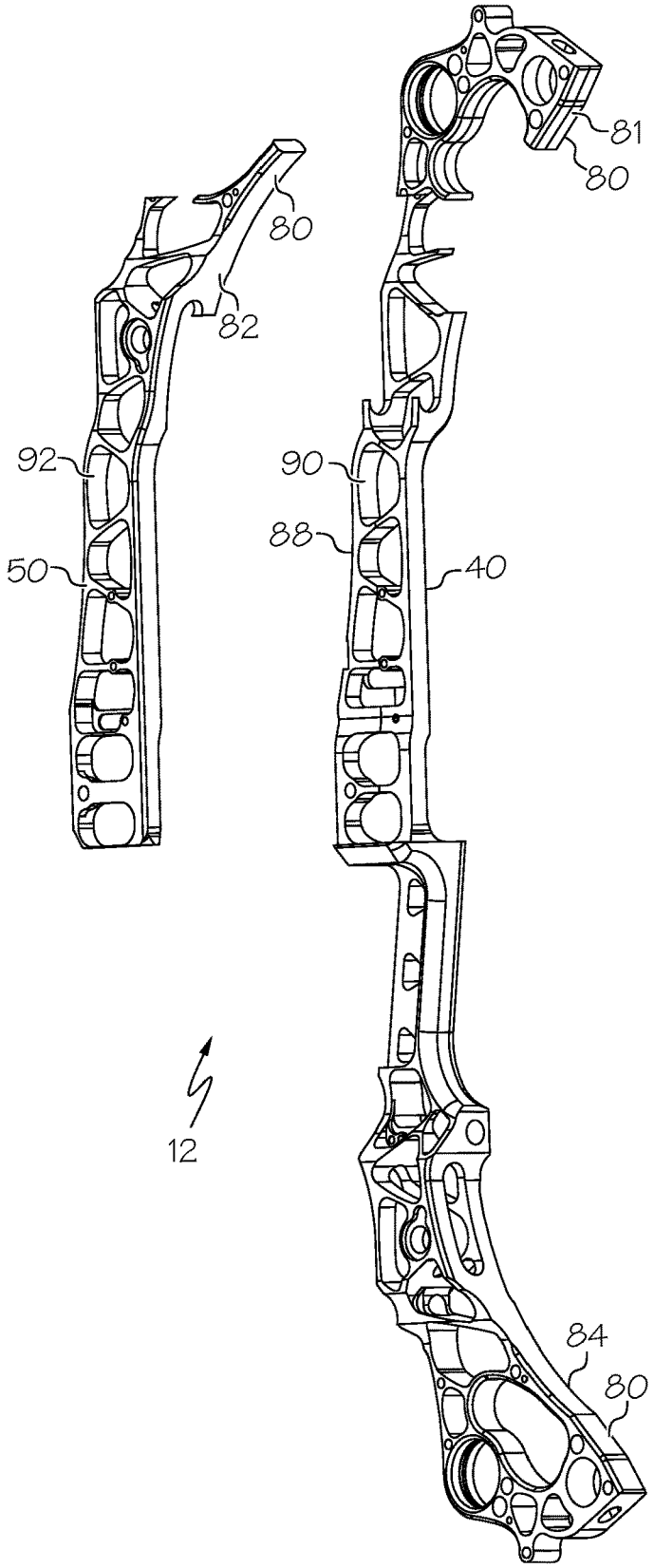
Figure 18:
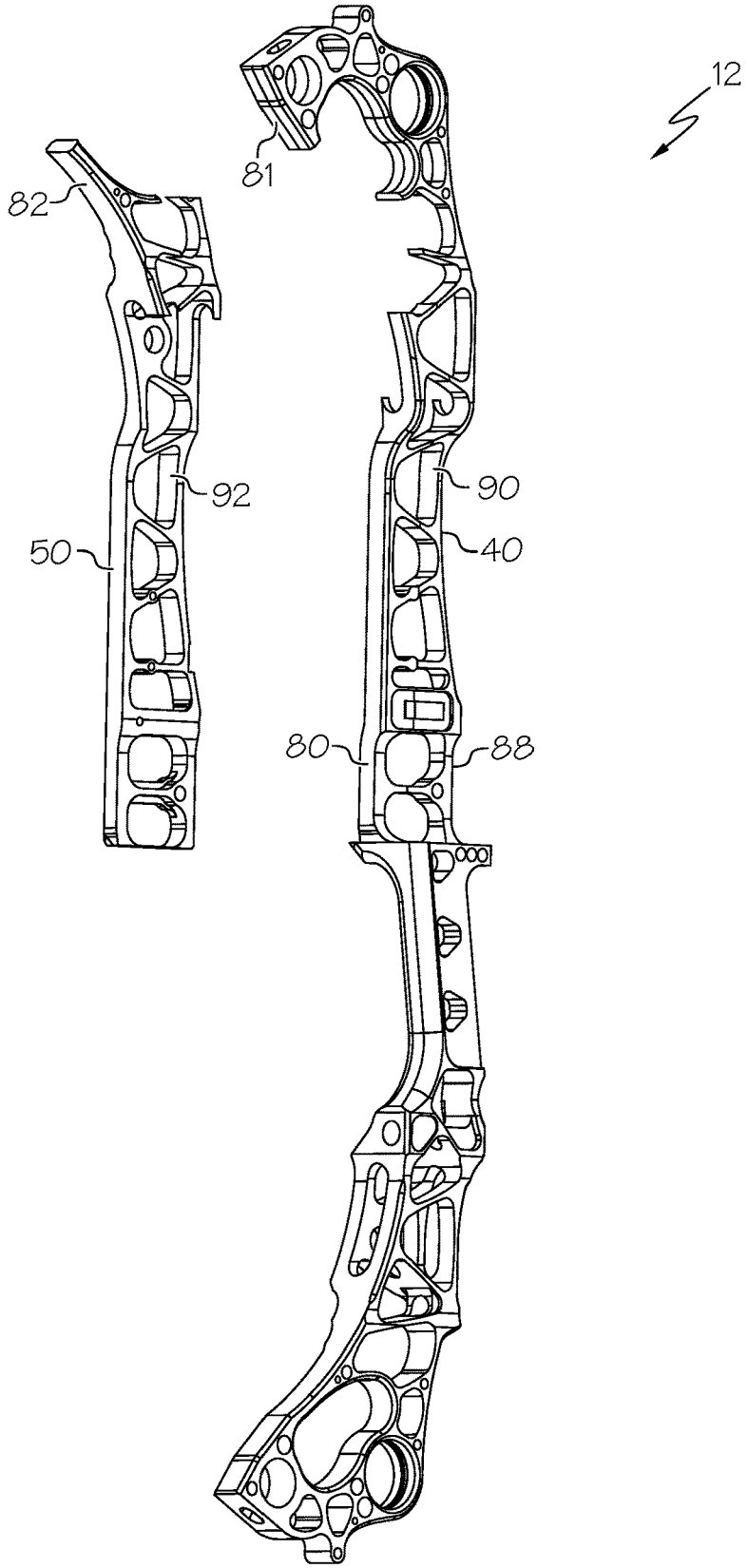
Figure 19:
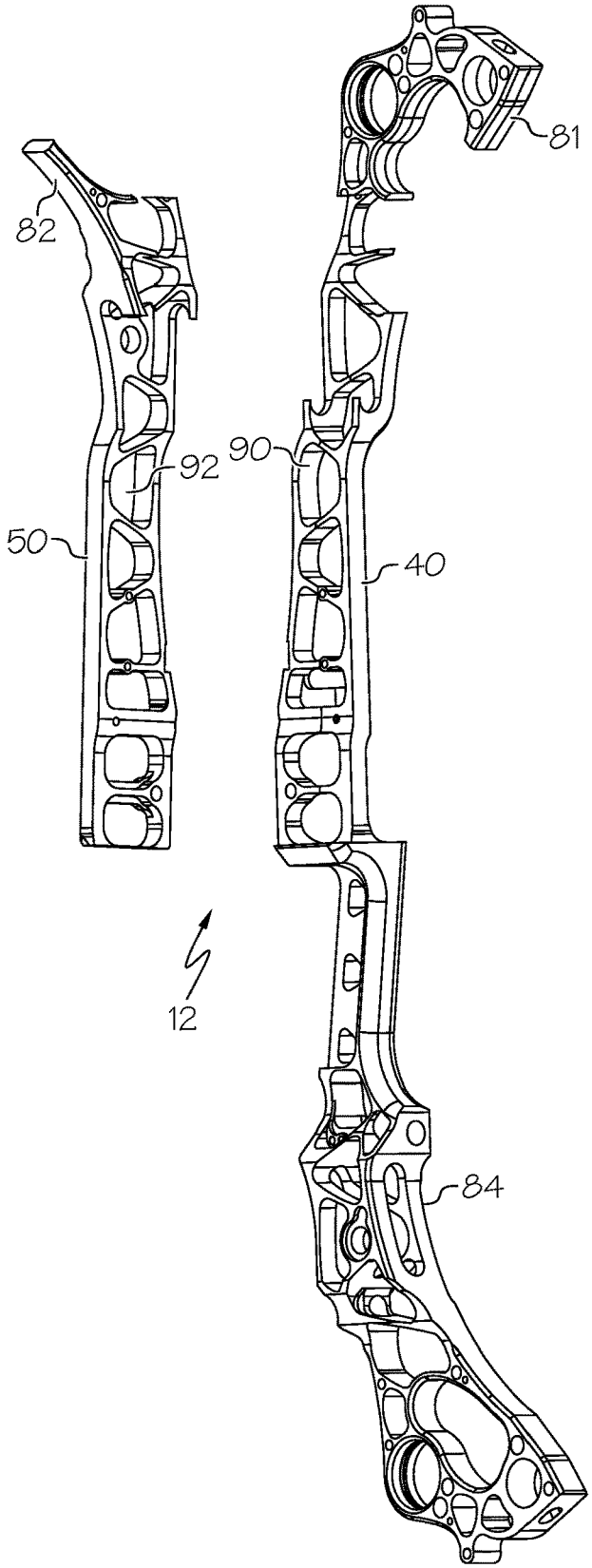
Figure 20:
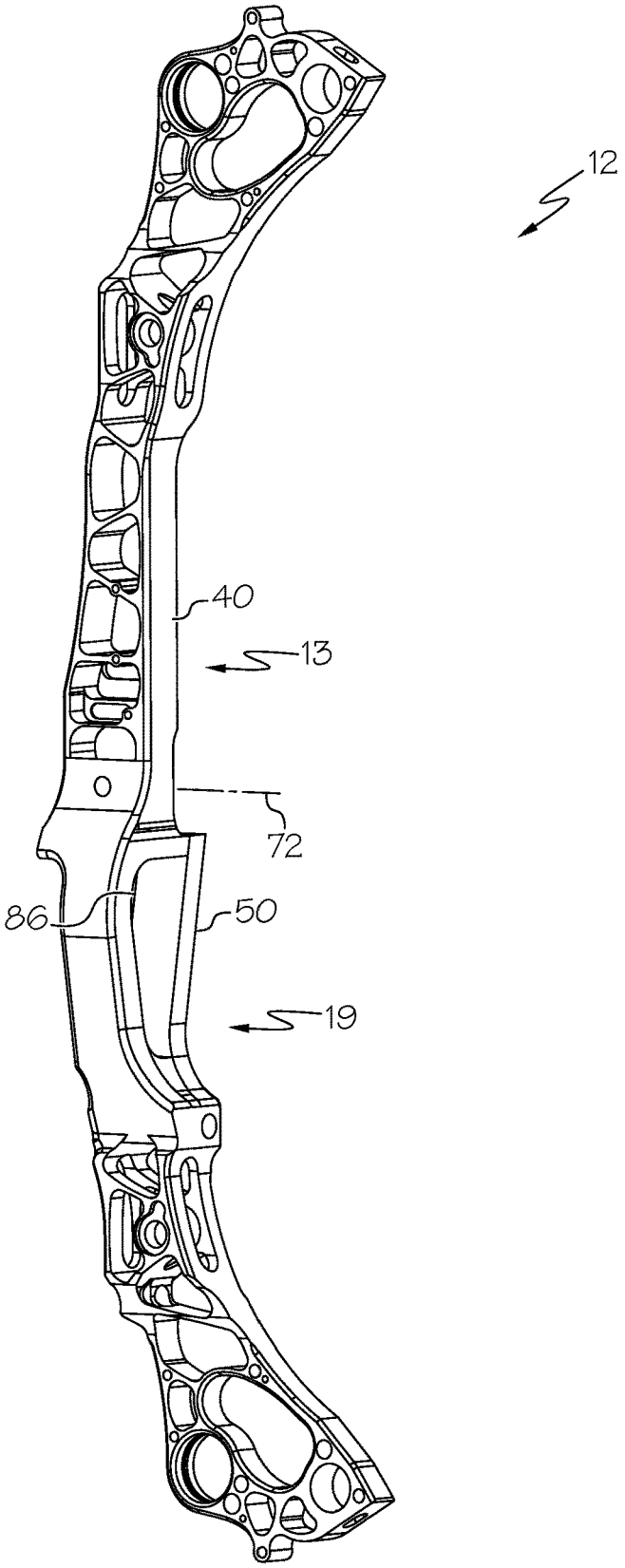
FIGS. 20-23 show another embodiment of a riser.
Figure 21:
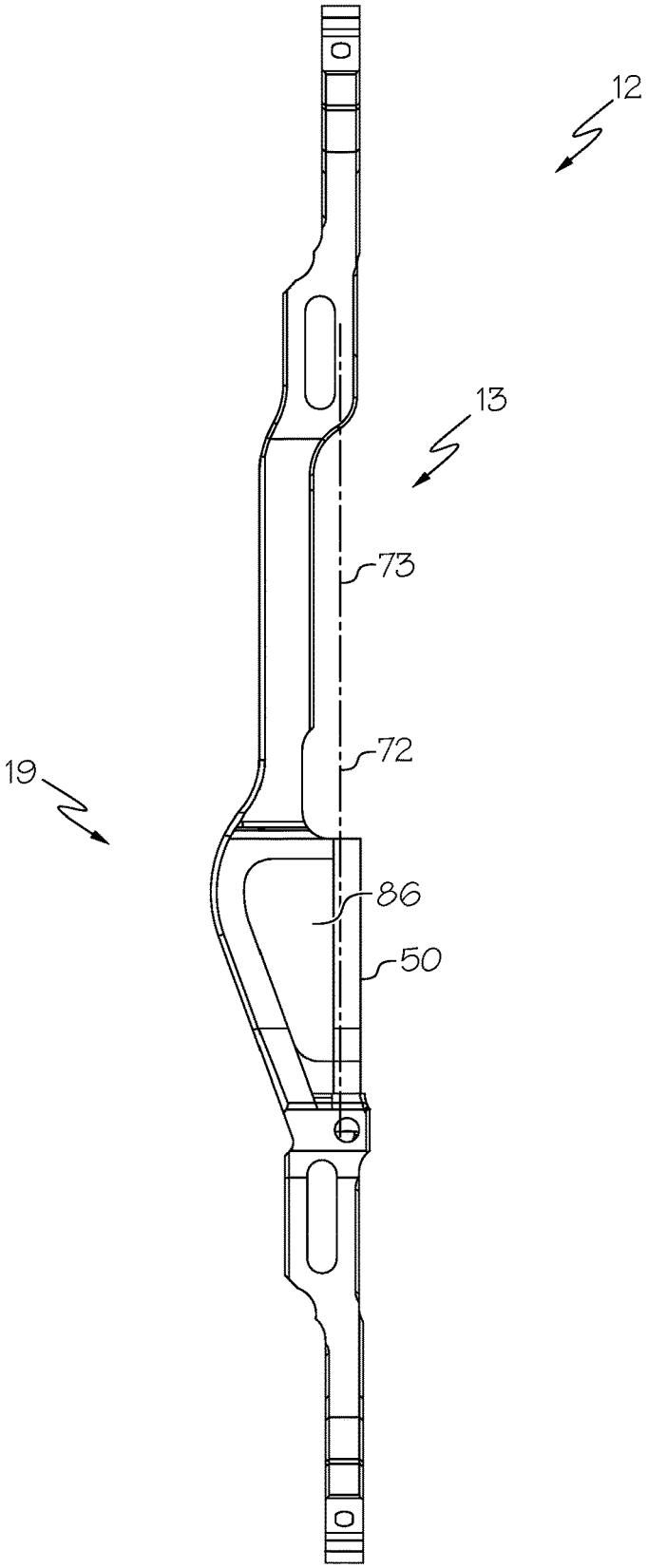
Figure 22:
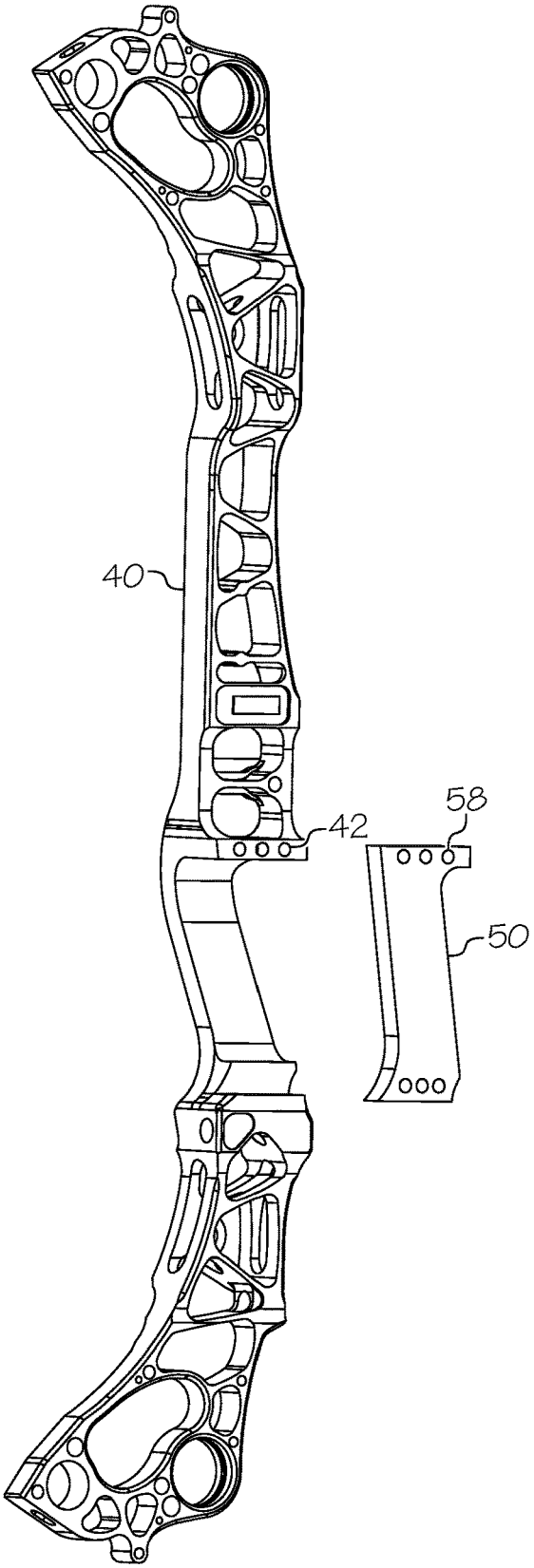
Figure 23:
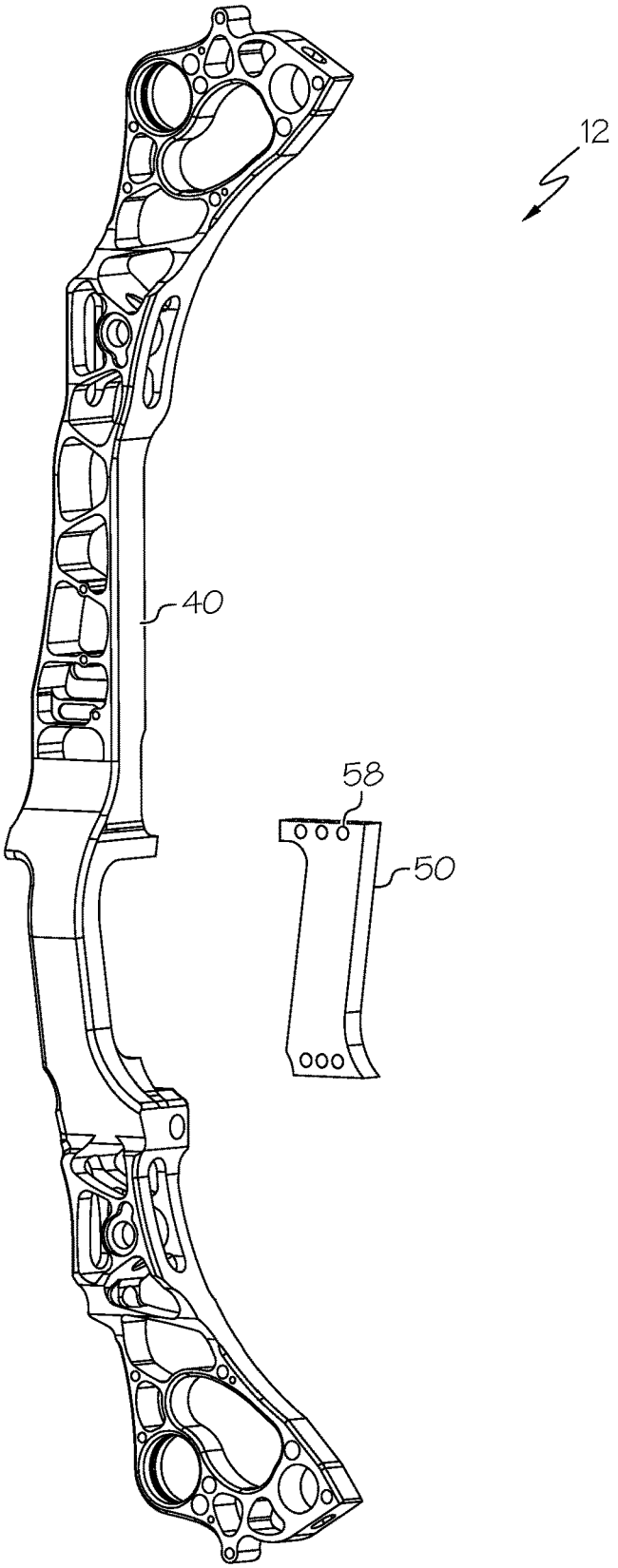

FIGS. 13-15 show an embodiment of a riser 12 and associated limb fasteners 34, such as a limb bolt 35 and a limb nut 36. FIG. 15 shows a limb cup 22 attached to the riser 12 via the limb fasteners 34.

Referring to FIGS. 9-15, desirably, the riser 12 is arranged to engage limb fasteners 34. In some embodiments, the first portion 40 engages a limb fastener 34. In some embodiments, the second portion 50 engages a limb fastener 34. In some embodiments, both the first portion 40 and the second portion 50 engage a limb fastener 34.

In some embodiments, the second portion 50 comprises one or more limb fastener apertures 60, which are constructed and arranged to engage a limb fastener 34. In some embodiments, the second portion 50 comprises a limb nut aperture 62 that is arranged to receive a limb nut 36. In some embodiments, the second portion 50 comprises a limb bolt aperture 61 that is arranged to receive a limb bolt 35. In some embodiments, the first tab portion 54 of the second portion 50 comprises limb fastener apertures 60. In some embodiments, the second tab portion 55 comprises a second set of limb fastener apertures 60.

In some embodiments, tensile forces applied by the first limb 14 are transferred to the second portion 50 by limb fasteners 34. In some embodiments, forces from the first limb 14 are applied to a first end of the second portion 50, for example being applied to the first tab portion 54. In some embodiments, tensile forces applied by the second limb 16 are transferred to the second portion 50 by a second set of limb fasteners 34. In some embodiments, forces from the second limb 16 are applied to a second end of the second portion 50, for example being applied to the second tab portion 55. In some embodiments, the second portion 50 comprises a continuous member that receives tensile forces applied by both limbs 14, 16. In some embodiments, the second portion comprises a single piece of material.

In some embodiments, the first portion 40 is arranged to engage a limb fastener 34. In some embodiments, the first portion 40 comprises a limb nut aperture 64 arranged to receive a limb nut 36. In some embodiments, a limb nut aperture 64 is located near an end of the first portion 40. In some embodiments, the limb nut aperture 64 is located in the first sidewall 46 that defines the first slot portion 44. In some embodiments, the first portion 40 comprises a second limb nut aperture 65 in proximity to the first limb nut aperture 64. In some embodiments, the second limb nut aperture 65 is located in the second sidewall 47 that defines the first slot portion 44. In some embodiments, the limb nut apertures 64, 65 near the first slot portion 44 are aligned with one another. In some embodiments, a second end of the first portion 40 is configured similarly to the first end, for example providing aligned limb nut apertures 64, 65 near the second slot portion 45.

In some embodiments, the tabs 54, 55 of the second portion 50 are oriented in the slot portions 44, 45 of the first portion 40. In some embodiments, one or more limb nut apertures 64, 65 of the first portion are aligned with a limb nut aperture 62 of the second portion. For example, the limb nut apertures 62, 64, 65 can comprise a similar shape and be aligned on a common axis. Thus, in some embodiments, both the first portion 40 and the second portion 50 engage a limb fastener 34.

In some embodiments, a limb nut 36 comprises a circular cross-sectional shape. In some embodiments, a limb nut 36 comprises a cylindrical outer shape. In some embodiments, limb nut apertures (e.g. 62, 64, 65) comprise a circular shape or circular shaped portions that receive the limb nut 36 and allow the limb nut 36 to rotate within the limb nut aperture 62, 64, 65.

In some embodiments, the second portion 50 comprises a material having a higher elastic modulus that the material of the first portion 40.

The second portion 50 as described herein is well suited to comprise a tension reinforcing member. In some embodiments, the second portion comprises carbon fiber, and is used in conjunction with a first portion 40 that is not carbon fiber. In some embodiments, the first portion 40 comprises a metal. Any suitable metal can be used, and relatively lightweight metals such as aluminum may be preferred.

In some embodiments, the second portion 50 comprises carbon fibers in a resin matrix. Any suitable construction comprising carbon fibers can be used. Carbon fibers can be produced using any suitable method including the use of polyacrylonitrile (PAN), the processing of pitch or any other suitable method. The carbon fibers and any suitable filler material, such as a resin, can be used to form a second portion 50 having any suitable size, shape and configuration. In some embodiments, the materials are cured in a mold. In some embodiments, the second portion 50 comprises layers of carbon fiber, and the fibers of adjacent layers are oriented in different directions. In some embodiments, the second portion 50 comprises carbon fibers in a weave pattern.

In some embodiments, the first portion 40 comprises a single piece of material. In some embodiments, the second portion 50 comprises a single piece of material.

FIGS. 16-19 show views of another embodiment of a riser 12. In some embodiments, a riser 12 comprises a tension rail 80 that extends continuously along a tension face 85 of the riser 12. In some embodiments, the tension rail 80 extends continuously from a first location near one limb nut aperture 64 to a second location near another limb nut aperture 64.

In some embodiments, the tension rail 80 comprises a first portion 81 that consists of the first portion 40 of the riser 12.

In some embodiments, the tension rail 80 comprises a second portion 82 that consists of the second portion 50 of the riser 12.

In some embodiments, the tension rail 80 comprises a third portion 83 that comprises the first portion 40 and the second portion 50 of the riser 12.

In some embodiments, the tension rail 80 comprises a fourth portion 84 that consists of the first portion 40 of the riser 12.

In some embodiments, the first portion 40 comprises a plurality of weight reducing apertures 90. The weight reducing apertures 90 can have any suitable size and shape. The weight reducing apertures 90 are typically included in interior portions of the riser 12 and do not extend into the tension rail 80 or a compression rail 88 located on a compression side of the riser 12.

In some embodiments, the second portion 50 comprises one or more weight reducing apertures 92. The weight reducing apertures 92 can have any suitable size and shape.

In some embodiments, weight reducing apertures 92 of the second portion 50 have sizes and shapes similar to weight reducing apertures 90 of the first portion 40. In some embodiments, similarly shaped weight reducing apertures 90, 92 are located adjacent one another and create a riser 12 that comprises a first portion 40 and a second portion 50, but has an appearance similar to a traditional riser.

FIGS. 20-23 show another embodiment of a riser 12 comprising a first portion 40 and a second portion 50. In some embodiments, the first portion 40 comprises a first material, such as metal, and the second portion 50 comprises a second material, such as a non-metal.

In some embodiments, a bow defines a bowstring plane 73, wherein a bowstring of the bow theoretically travels in the bowstring plane 73 as the bow is drawn and fired. Desirably, the shooting axis 72 of the bow is positioned in the bowstring plane 73.

In some embodiments, the riser 12 defines a sight window 13. In some embodiments, the sight window 13 is aligned upon the bowstring plane 73 and the riser 12 comprises structure positioned lateral to the sight window 12. In some embodiments, the first portion 40 comprises the structure extending adjacent to the sight window 13.

In some embodiments, the second portion 50 is positioned below the sight window 13. In some embodiments, a portion of the second portion 50 overlaps the bowstring plane 73.

In some embodiments, the riser 12 comprises a grip area 19 comprising structure defining an aperture 86. In some embodiments, a portion of a shooter's hand is oriented in the aperture 86 when the riser 12 is grasped. In some embodiments, the aperture 86 is partially defined by the first portion 40 of the riser 12 and is partially defined by the second portion 50 of the riser 12. In some embodiments, the first portion 40 is located to a first side of the aperture 86 and the second portion 50 is located to a second side of the aperture 86. In some embodiments, the first portion 40 is located to a first side of the bowstring plane 73 and the second portion 50 is located to a second side of the bowstring plane 73.

The risers 12 disclosed herein can be used in any type of bow, including all types of compound bows (e.g. single cam, dual cam, etc.) and non-compound bows (e.g. traditional and recurve).

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow riser comprising:

a body defining a first end, a second end and a grip portion, the body defining a shooting axis;

the body comprising a first portion and a second portion, the first portion comprising a metal, the second portion comprising carbon fibers;

the first portion extending to a first side of the shooting axis and to a second side of the shooting axis;

the second portion extending to the first side of the shooting axis and to the second side of the shooting axis;

wherein a front surface of the first portion is aligned with a front surface of the second portion.

2. The archery bow riser of claim 1, comprising an adhesive attaching the first portion to the second portion.

3. The archery bow riser of claim 1, the first portion defining a cavity, the second portion oriented in the cavity.

4. The archery bow riser of claim 1, the second portion extending continuously for at least one-quarter of a length of the riser.

5. The archery bow riser of claim 1, the second portion extending continuously for at least one-third of a length of the riser.

6. The archery bow riser of claim 1, the second portion extending continuously for at least one-half of a length of the riser.

7. The archery bow riser of claim 1, the second portion comprising a straight portion and a curved portion.

8. The archery bow riser of claim 1, the body comprising a first limb engagement location and a second limb engagement location, the first portion extending continuously from the first limb engagement location to the second limb engagement location, the second portion extending continuously from the first limb engagement location to the second limb engagement location.

9. An archery bow comprising:

a riser engaged with a first limb fastener and a second limb fastener, the riser comprising a first portion comprising metal and a second portion comprising carbon fiber, the riser comprising a tension surface and a compression surface, the tension surface comprising the first portion and the second portion, the second portion receiving tensile forces from the first limb fastener and from the second limb fastener;

wherein the compression surface excludes the second portion.

10. The archery bow of claim 9, the second portion comprising a first aperture arranged to receive the first limb fastener and a second aperture arranged to receive the second limb fastener.

11. The archery bow of claim 10, wherein the first limb fastener comprises a first limb nut, the bow further comprising a limb bolt attached to the first limb nut, the second portion comprising a limb bolt aperture.

12. The archery bow of claim 10, the first portion comprising a limb nut aperture aligned with the first aperture.

13. An archery bow comprising:

a riser;

a first limb supported by the riser at a first support location;

a second limb supported by the riser at a second support location, the riser comprising a first portion comprising a first material and a second portion comprising a second material, the second material having a higher elastic modulus than the first material;

the first portion extending from the first support location to the second support location, the first portion arranged to receive compressive forces from the first and second limbs;

the second portion extending from the first support location to the second support location, the second portion arranged to receive tensile forces from the first and second limbs;

the first limb attached to the riser by a limb bolt and a limb nut, the first portion comprising a first limb nut aperture;

the second portion comprising a second limb nut aperture aligned with the first limb nut aperture;

the first portion comprising a third limb nut aperture aligned with the first limb nut aperture.

14. The archery bow of claim 13, the second portion comprising a limb bolt aperture.

15. The archery bow of claim 13, the first portion comprising a slot, the second portion oriented in the slot.

* * * * *